United States Patent [19]

Reiniche

[11] Patent Number: 4,830,684

[45] Date of Patent: May 16, 1989

[54] PROCESS FOR HEAT TREATING A CARBON STEEL WIRE

[75] Inventor: Andre Reiniche, Clermont-Ferrand, France

[73] Assignee: Compagnie Generale des Etablissements Michelin, Clermont-Ferrand Cedex, France

[21] Appl. No.: 122,113

[22] Filed: Nov. 18, 1987

[30] Foreign Application Priority Data

Nov. 27, 1986 [FR] France ..... 86 16705

[51] Int. Cl.[4] ..... C21D 1/40

[52] U.S. Cl. ..... 148/128; 148/154; 148/156

[58] Field of Search ..... 148/150, 154, 156, 128

[56] References Cited

U.S. PATENT DOCUMENTS

| | | | |
|---|---|---|---|
| 3,547,421 | 12/1970 | Hoffman et al. | 148/156 |
| 3,645,805 | 2/1972 | Hoffmann et al. | 266/3 |
| 3,830,478 | 8/1974 | Pletroni | 148/156 |
| 4,043,170 | 8/1977 | Erodi et al. | 148/128 |
| 4,249,720 | 2/1981 | Weyand et al. | 266/104 |

FOREIGN PATENT DOCUMENTS

| | | | |
|---|---|---|---|
| 433222 | 11/1974 | U.S.S.R. | 148/154 |
| 1224347 | 4/1986 | U.S.S.R. | 148/128 |

OTHER PUBLICATIONS

Patent Abstracts of Japan, vol. 5, No. 54, (C-50) [726], Apr. 15, 1981, JP-A-56 5931, (Sumitomo Kinzoku Kogyo K.K.).

*Primary Examiner*—Christopher W. Brody
*Attorney, Agent, or Firm*—Brumbaugh, Graves, Donohue & Raymond

[57] ABSTRACT

A process for heat treating a carbon steel wire to obtain a fine pearlite structure is characterized by the following steps: (a) cooling the wire until the wire reaches a given temperature which is below the $AC_1$ transformation temperature; (b) regulating the temperature of the wire to not more than 10° C. above or below said given temperature by passing an electric current through the wire and effecting a modulated ventilation thereof; (c) cooling the wire.

13 Claims, 7 Drawing Sheets

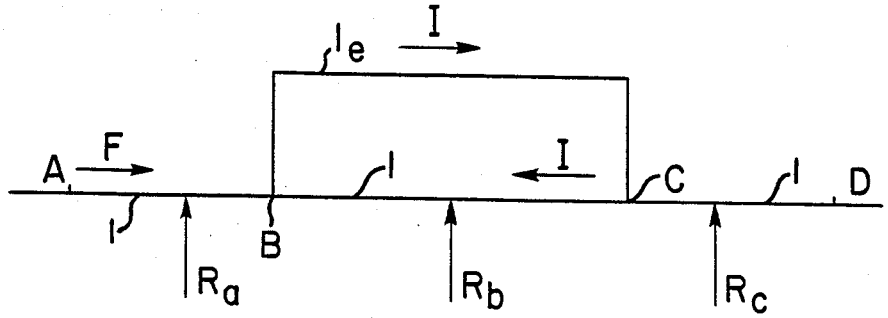
FIG. 1
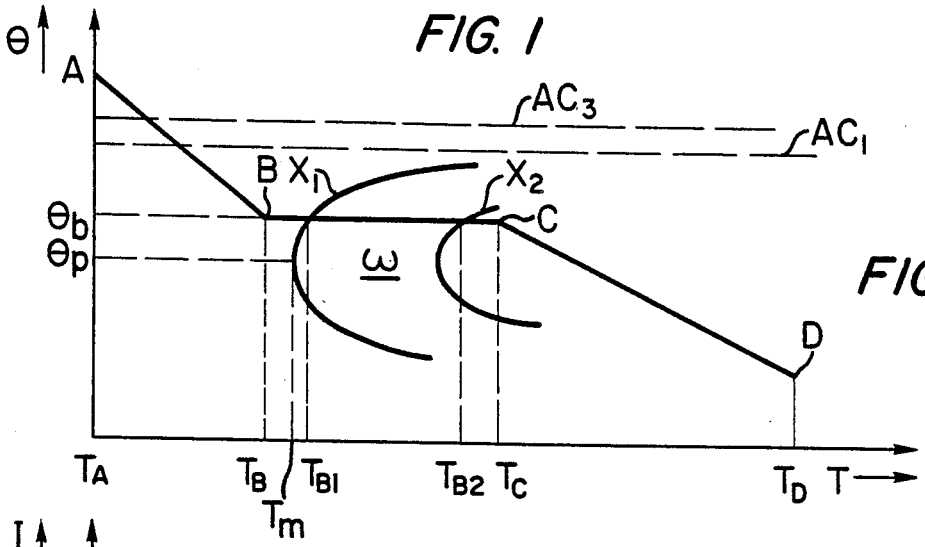
FIG. 2A
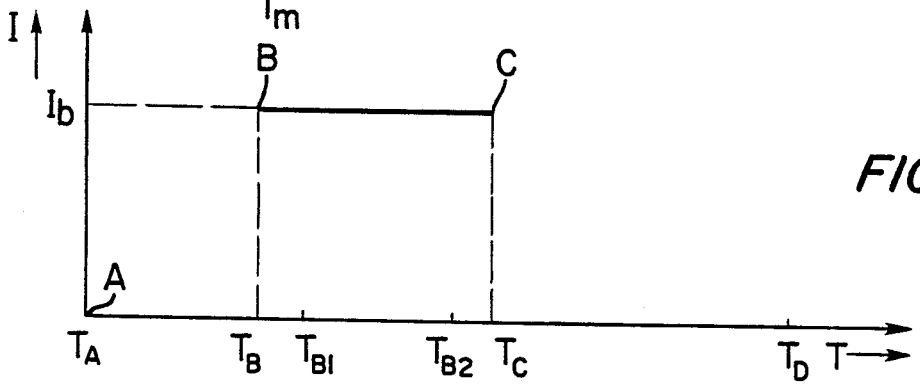
FIG. 2B
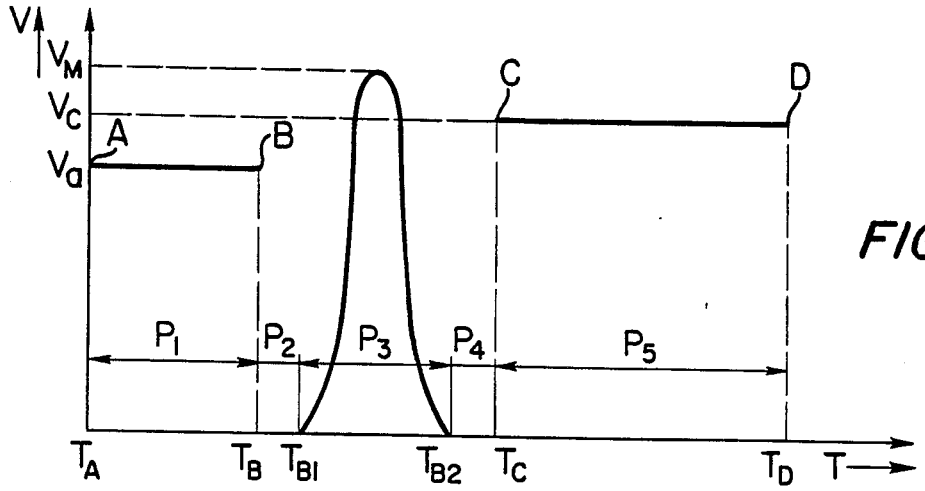
FIG. 2C
FIG. 2

PROCESS FOR HEAT TREATING A CARBON STEEL WIRE

BACKGROUND OF THE INVENTION

The present invention relates to processes and installations for the heat treatment of metal wires, and more particularly carbon steel wires, these wires being used to reinforce articles of rubber and/or of plastic material or materials, for instance pneumatic tires.

These heat treatments have the purpose, on the one hand, of increasing the wiredrawing capability of the wires and, on the other hand, of improving their mechanical properties and their endurance.

The known treatments of this type comprise two phases:

a first phase which consists in heating the wire and maintaining the wire at a temperature above the $AC_3$ transformation temperature to obtain a homogeneous austenite:

a second phase which consists in cooling the wire to obtain a fine pearlite structure.

One of the most common of these processes is a heat treatment known as "patenting" which consists of an austenitizing of the wire at a temperature of 800° to 950° C. followed by immersion in a bath of molten lead or salts maintained at a temperature of 450° to 600° C.

The good results obtained, particularly in the case of the heat treatment with lead, are generally attributed to the fact that the very high coefficients of convection which are obtained between the wire and the cooling fluid permit, on the one hand, a rapid cooling of the wire between the $AC_3$ transformation temperature and a temperature slightly higher than that of the lead and, on the other hand, a limiting of the "recalescence" during the transformation of the metastable austenite into pearlite, the recalescence being an increase in the temperature of the wire due to the fact that the energy contributed by the metallurgical transformation is greater than the energy lost by radiation and convection.

Patenting, unfortunately, results in high costs since the handling of liquid metals or molten salts leads to cumbersome technologies and the necessity of cleaning the wire after the patenting.

Furthermore, lead is very toxic and the health problems to which it gives rise lead to substantial expenses.

SUMMARY OF THE INVENTION

The object of the present invention is to carry out a heat treatment without the use of molten metals or salts during the transformation of austenite into pearlite while obtaining results which are at least as good as with the patenting processes.

Therefore, the invention concerns a process for heat treating a carbon steel wire to obtain a fine pearlite structure, this process being characterized by the following three steps:

(a) the wire, which has been previously maintained at a temperature above the $AC_3$ transformation temperature to obtain a homogeneous austenite, is cooled until the wire reaches a given temperature which is below the $AC_1$ transformation temperature and above the temperature of the nose of the curve of the start of the transformation of metastable austenite into pearlite, the wire then having a metastable austenite structure without pearlite;

(b) then regulating the temperature of the wire to not more than 10° C. above or below said given temperature, this regulation being obtained by passing an electric current through the wire for a period of time greater than the pearlitization time and by effecting a modulated ventilation for a part of this time;

(c) then cooling the wire.

The invention also concerns a device for carrying out the process defined above.

This device for heat treating a carbon steel wire to obtain a fine pearlite structure is characterized by the fact that it comprises:

(a) means for cooling the wire which has been previously maintained at a temperature above the $AC_3$ transformation temperature, these cooling means permitting the wire to reach a given temperature which is below the $AC_1$transformation temperature and above the temperature of the nose of the curve of the start of the transformation of metastable austenite into pearlite, the wire then having a metastable austenite structure without pearlite;

(b) means for then regulating the temperature of the wire to not more than 10° C. above or below said given temperature for a period of time greater than the pearlitization time, these regulating means comprising electric means for passing an electric current through the wire and means for modulated ventilation of the wire;

(c) means for then cooling the wire.

The invention also concerns the wires obtained by the process and/or device in accordance with the invention.

The invention will be readily understood by means of the following non-limitative examples and the entirely schematic figures covering these examples.

DESCRIPTION OF THE DRAWING

In the drawing:

FIG. 1 is a diagram showing schematically the carrying out of the process in accordance with the invention;

Figure 3:
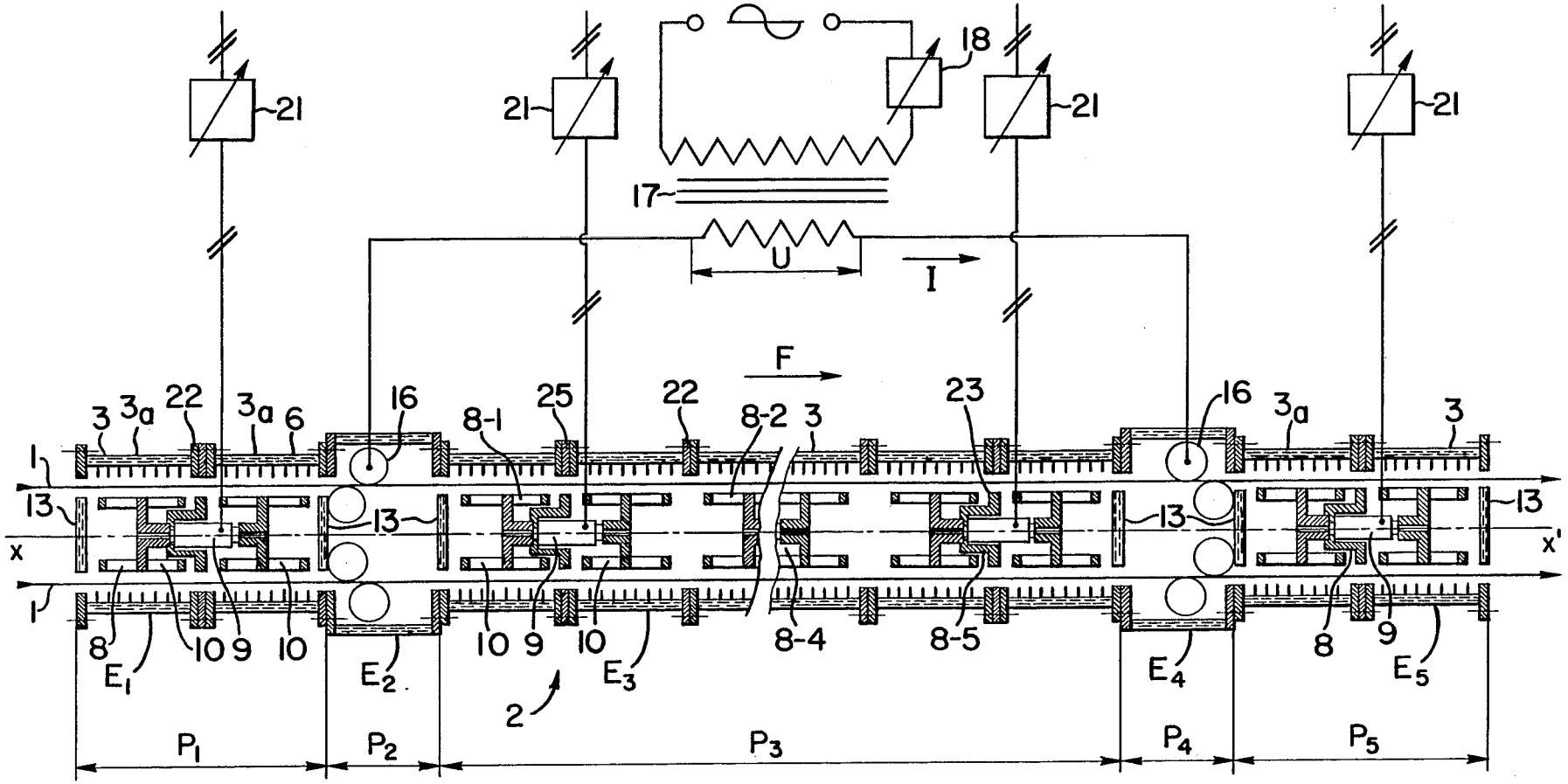
Figure 4:
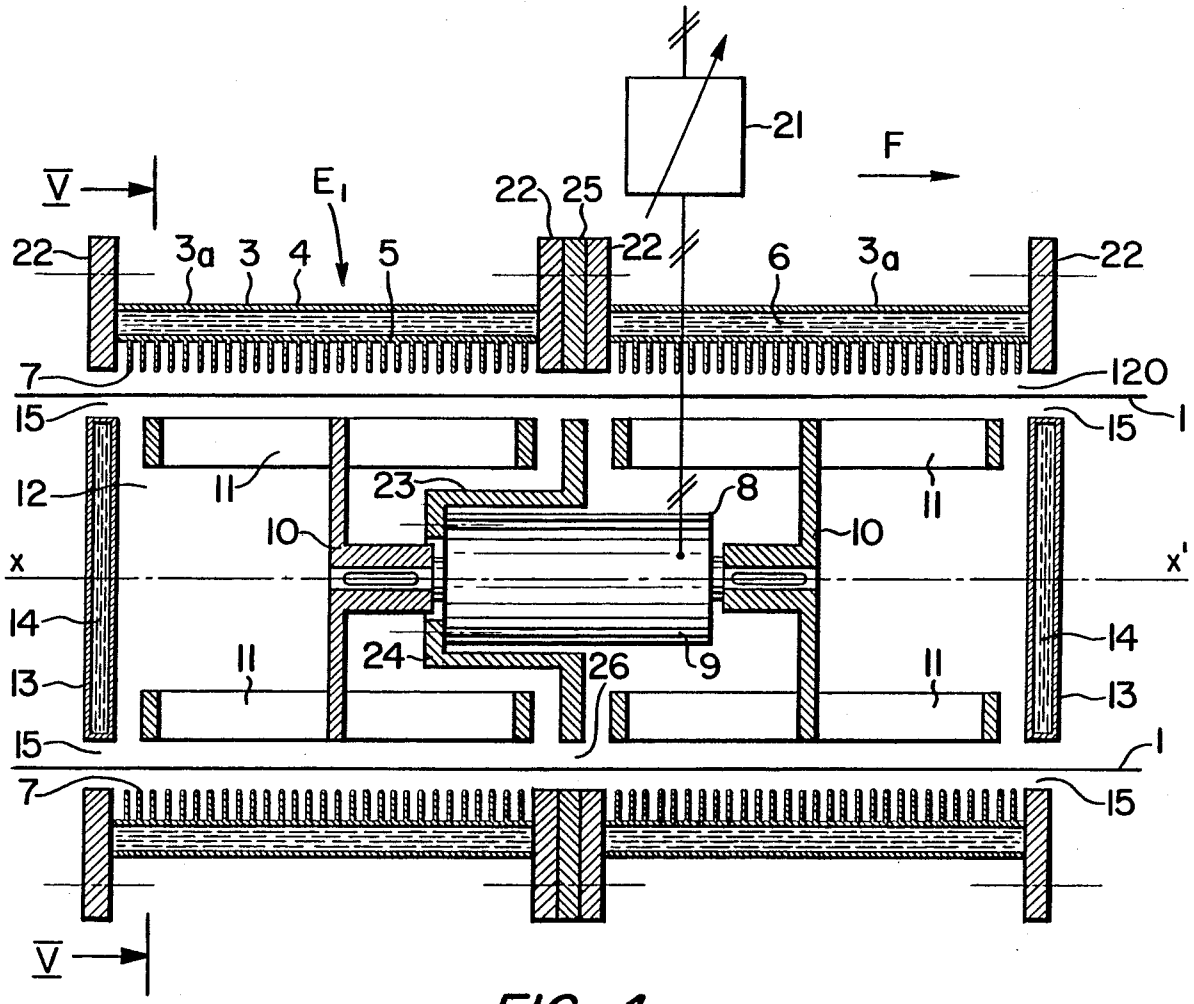
Figure 5:
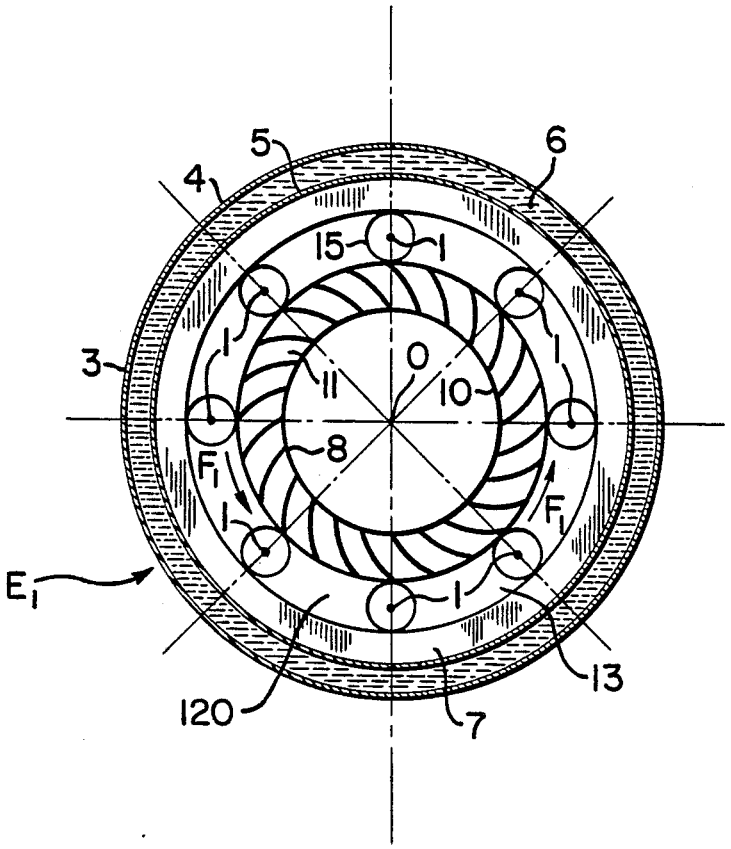
Figure 7:
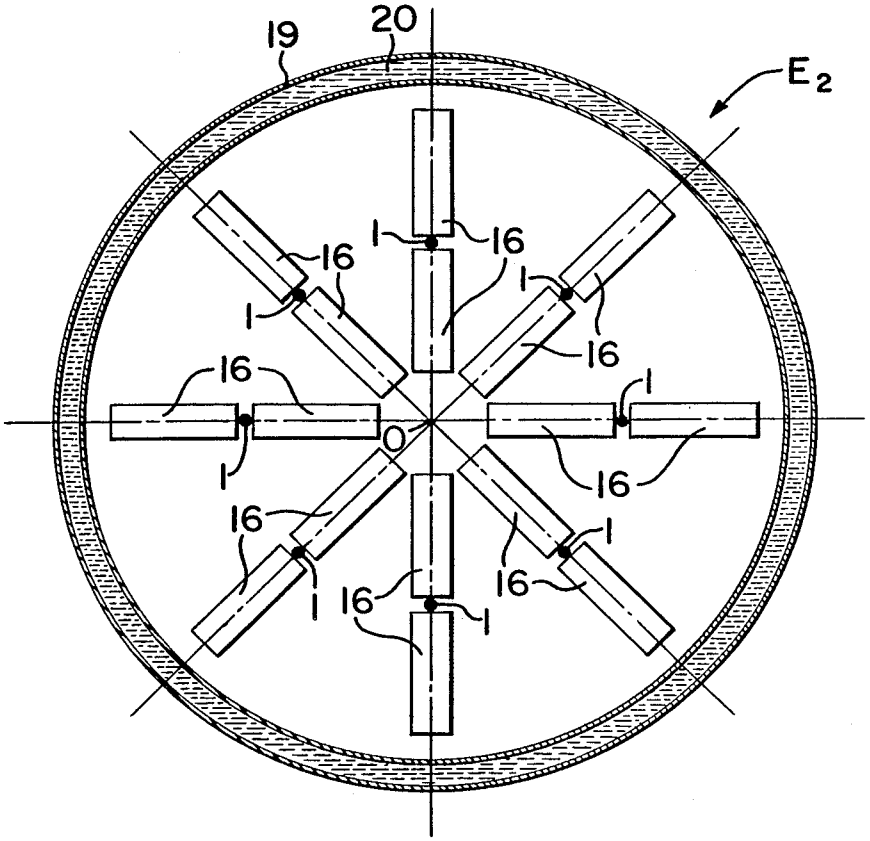
Figure 6:
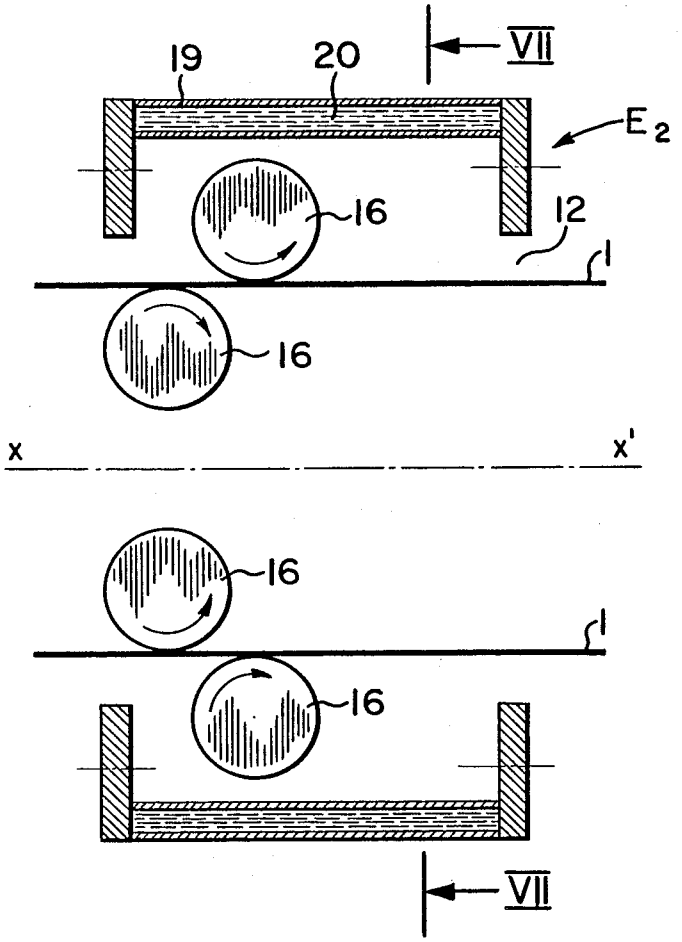
Figure 8:
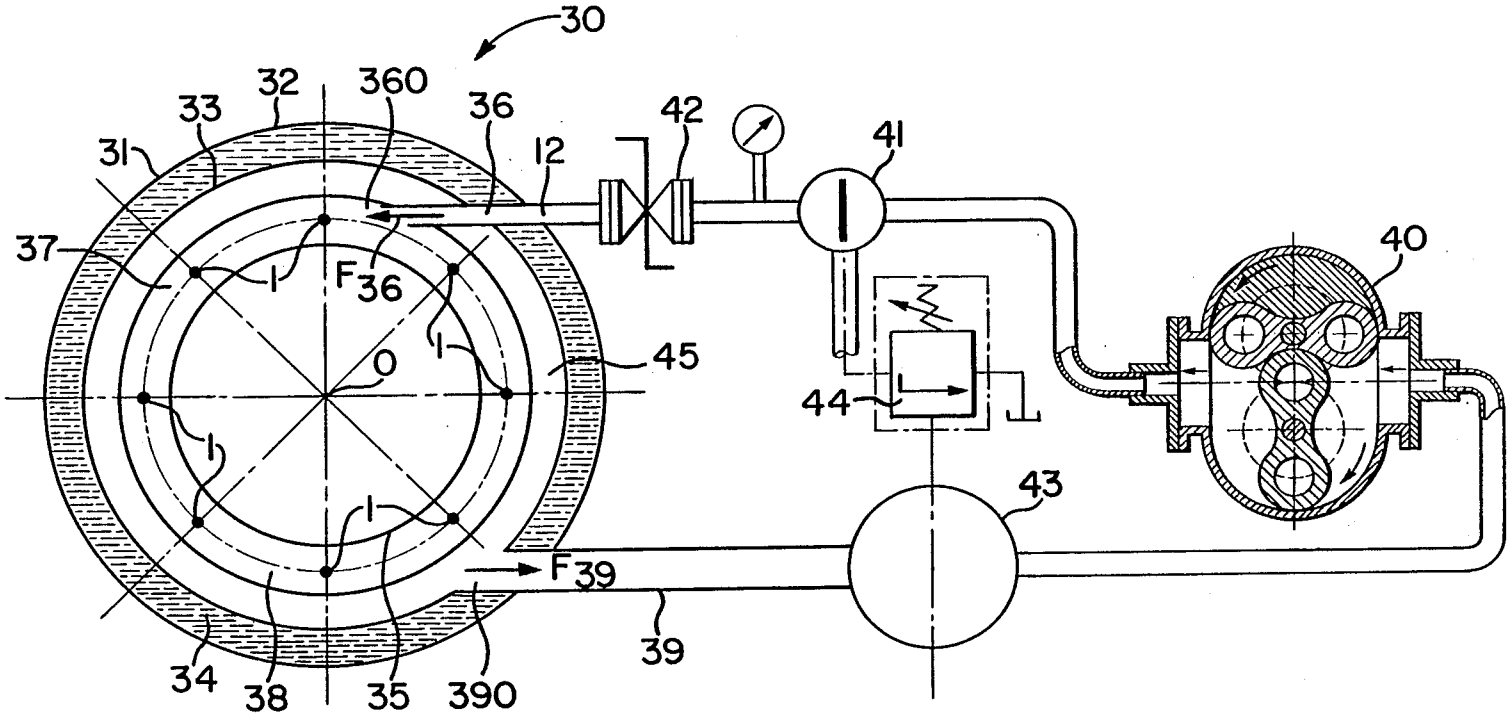
Figure 9:
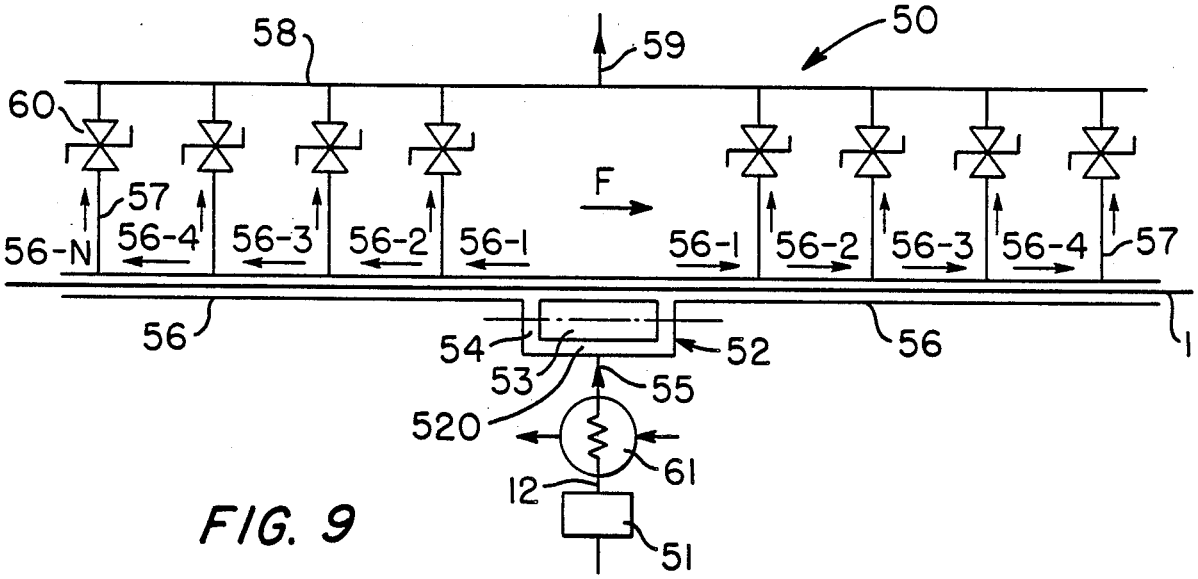
Figure 10:
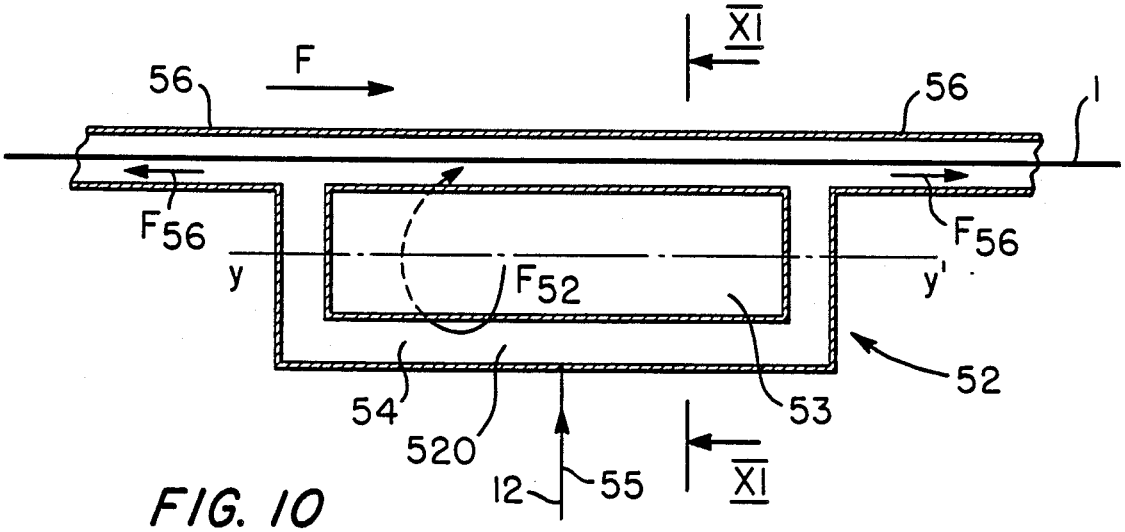
Figure 11:
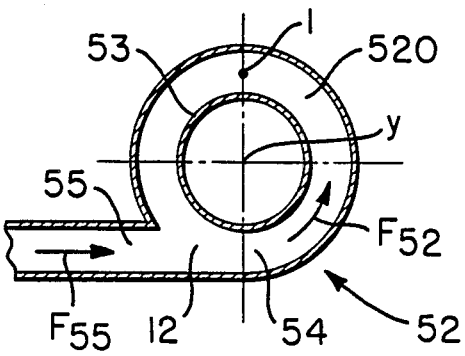
Figure 12:
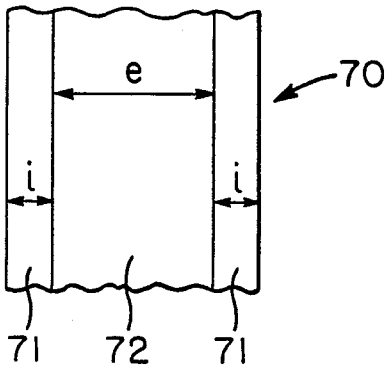

FIGS. A-C show as a function of time, the variations of the temperature of the wire, the intensity of the electric current flowing in the wire and the speed of ventilation upon the carrying out of the process of the invention;

FIG. 3 shows, in cross section, a part of a device in accordance with the invention having five cooling enclosures and an axis, said section being taken along that axis;

FIG. 4 shows in cross section the first enclosure of the device according to the invention, which has been shown in part in FIG. 3, this section being taken along the axis of this device;

FIG. 5 shows in cross section the first enclosure of the device according to the invention, which has been shown in part in FIG. 3, this section which is taken perpendicular to the axis of this device being indicated schematically by the lines V—V in FIG. 4;

FIG. 6 shows in cross section the second enclosure of the device according to the invention, which has been shown in part in FIG. 3, this section being taken along the axis of this device;

FIG. 7 shows in cross section the second enclosure of the device according to the invention, which has been shown in part in FIG. 3; this section is taken perpendicular to the axis of said device and is indicated schematically by the lines VII—VII in FIG. 6;

FIG. 8 shows in cross section an apparatus which makes it possible to obtain a rotary gaseous ring, this apparatus being capable of use in the device according to the invention, which has been shown in part in FIG. 3, this section being taken perpendicular to the axis of said device;

FIG. 9 shows another device according to the invention, this device having a distribution apparatus with a cylinder;

FIG. 10 shows in greater detail, in cross section, the distribution apparatus of the device shown in FIG. 9, this section being taken along the axis of the cylinder of this distribution apparatus;

FIG. 11 shows in greater detail, in cross section, the distribution apparatus of the device shown in FIG. 9, this section, which is taken perpendicular to the axis of the cylinder of the distribution apparatus, being indicated schematically by the lines XI—XI in FIG. 10;

FIG. 12 shows in cross section a portion of the fine pearlite structure of a wire treated in accordance with the invention.

DETAILED DESCRIPTION OF THE INVENTION

FIG. 1 is a diagram showing schematically the operations effected upon the carrying out of the process of the invention.

A wire 1 is used which is a carbon steel wire. This wire 1 moves in the direction of the arrow F over a path which contains the points A, B, C, D.

The process of the invention comprises three steps:

(a) The wire 1, which has been previously maintained at a temperature above the $AC_3$ transformation temperature to obtain a homogeneous austenite, is cooled between points A and B until the wire reaches a given temperature which is below the $AC_1$ transformation temperature and above the temperature of the nose of the curve of the start of the transformation of metastable austenite into pearlite. This cooling is indicated schematically by the arrow $R_a$. Said given temperature permits the further transformation of metastable austenite into pearlite. The cooling $R_a$ is effected within a period of time which is sufficiently short so that there is no transformation of the austenite into pearlite, the wire at point B then having a metastable austenite structure without pearlite.

(b) Between points B and C the temperature of the wire 1 is regulated to not more than 10° C. above or below said given temperature, this regulation being obtained by passing an electric current through the wire 1 for a period of time greater than the pearlitization time and by effecting a cooling which is indicated schematically by the arrow $R_b$. This cooling is effected by a modulated ventilation, that is to say a ventilation the speed of which is varied during the course of the time that the wire 1 passes between the points B and C. This ventilation is effected only during a part of the time during which the electric current is passed through the wire 1.

The passage of the electric current through the wire 1 between the points B and C is indicated schematically by the electric circuit $l_e$ of which the wire 1 is a part and by the arrows I, I representing the intensity of the electric current flowing in the circuit $l_e$ and therefore in the wire 1.

(c) Between points C and D this wire 1 is cooled to a temperature which is, for instance, close to ambient temperature, this cooling being indicated schematically by the arrow $R_c$.

By way of example, the coolings $R_a$ and $R_c$ are also carried out by ventilation.

FIG. 2 shows, as a function of time, three graphs 2A, 2B, 2C corresponding to the following three variations upon the carrying out of the process of the invention;

FIG. 2A shows the variation of the temperature of the wire 1;

FIG. 2B shows the variation of the intensity of the electric current flowing in the wire 1;

FIG. 2C shows the variation of the speed of ventilation upon the coolings $R_a$, $R_b$, $R_c$, that is to say the speed of the cooling gas.

In these graphs, time is represented by T, temperature by $\theta$, electric intensity by I, and speed of ventilation by V. In all of these graphs, the time T is plotted on the x-axis and the changes in $\theta$, I and V are shown on the y-axis. For simplicity in description, it will be assumed that the temperature $\theta$ of the wire is constant between the points B and C.

The three steps of the process are then represented in the graph of the temperatures $\theta$ (FIG. 2A) by a temperature plateau $\theta_b$ corresponding to step (b), preceded and followed by a drop in temperature corresponding to steps (a) and (c). These three steps are furthermore indicated on the graph of the current intensity I by a non-zero intensity plateau $I_b$ corresponding to step (b), preceded and followed by a plateau of zero intensity corresponding to steps (a) and (c). Upon step (b) the modulated ventilation is not applied either at the start or at the end of this step; it is applied only during the time interval $T_{B1}$, $T_{B2}$, the step (b) therefore comprising three phases. The process thus comprises five phases bounded in the graphs of FIG. 2 by the times 0 (corresponding to the time $T_A$ taken as origin), $T_B$, $T_{B1}$, $T_{B2}$, $T_C$, $T_D$, the times $T_{B1}$ and $T_{B2}$ taking place during step (b). The carrying out of the process upon these five phases leads to modifications in the structure of the steel of the wire 1 which are indicated schematically in FIG. 2A.

Phase 1

Before the wire 1 arrives at point A, it has been previously brought to a temperature above the $AC_3$ transformation temperature, the wire 1 having been brought, for instance, to a temperature of between 800° and 950° C., and it has been maintained at this temperature so as to obtain a homogeneous austenite. When the wire 1 arrives at point A its temperature is therefore above the $AC_3$ transformation temperature and it has a structure comprising homogeneous austenite.

In FIG. 2A there is shown the curve $X_1$ which corresponds to the start of the transformation of metastable austenite into pearlite, as well as the curve $X_2$ which corresponds to the end of the transformation of metastable austenite into pearlite, the nose of the curve $X_1$, that is to say the temperature $\theta_p$ corresponding to the minimum time $T_m$ of said curve $X_1$.

Between points A and B, that is to say between the time 0 and $T_B$, the wire 1 is cooled, the average speed of this cooling, which is preferably rapid, being, for instance, from 100° to 400° C./second so that the wire 1 reaches a given temperature $\theta_b$ which is below the $AC_1$ transformation temperature and above the temperature of the pearlite nose $\theta_p$, this temperature $\theta_b$ permitting the transformation of metastable austenite into pearlite.

Phase 1, the duration of which is designated $P_1$ on the time axis T of FIG. 2C, is represented in the diagrams of FIG. 2 by a drop in temperature $\theta$, by a zero current intensity I and by a high ventilation velocity plateau $V_a$, this phase 1 corresponding to step (a).

During this cooling, which is preferably rapid, "seeds" are developed at the grain boundaries of the metastable austenite, which "seeds" are smaller and more numerous the faster the rate of cooling. The seeds are starting points for the further transformation of the metastable austenite into pearlite, and it is well known that the fineness of the pearlite, and therefore the value in use of the wire, will be greater the more numerous and smaller these seeds are. The obtaining of high cooling speeds, in particular in the case of wire diameters greater than 1 mm, is due to the combined use of a cooling gas having good forced convection performance and the use of rapid ventilation speeds of, for instance, between 2 and 50 meters/second for radial ventilation and between 10 and 100 meters/second for axial ventilation.

Phases 2, 3, 4 which follow correspond to step (b).

Phase 2

The wire 1 is maintained at the selected treatment temperature $\theta_b$ due to the flow of the electric current $I_b$ without any ventilation effected.

In the graph of FIG. 2C, the duration of this phase 2 is represented by the time interval $P_2$ from the time $T_B$ to the time $T_{B1}$, the temperature of the wire 1 has the fixed value $\theta_b$, the electric intensity has the fixed value $I_b$, and the rate of ventilation is zero.

This phase 2 of the heat treatment is advantageously carried out within a cooling enclosure having natural convection. During this phase 2, the rate of formation of the seeds is very high and their size is minimum.

Phase 3

During this phase 3, there is transformation of metastable austenite to pearlite. In order to avoid an increase in the temperature of the wire 1, that is to say a recalescence as a result of the energy contributed by the metallurgical transformation of austenite into pearlite, a modulated ventilation is effected while maintaining the electric current intensity $I_b$ in the wire 1. In the graph of FIG. 2C the duration of this phase 3 is represented by the period of time $P_3$ between the times $T_{B1}$ and $T_{B2}$, the temperature of the wire 1 is maintained at the fixed value $\theta_b$, and the electric intensity is maintained at the fixed value $I_b$. The ventilation is modulated in the following manner: The speed of ventilation has a low value or a value of zero at the time $T_{B1}$, at the start of this phase 3. It then increases to reach a maximum $V_M$ and then decreases to reach a low or zero value at the time $T_{B2}$ at the end of this phase 3.

This ventilation is modulated, that is to say at each instant it has a value such that the energy lost by the wire 1 as a result of convection and radiation is equal to the energy contributed to the wire 1 by Joule effect plus the energy contributed to the wire 1 by the austenite→ pearlite metallurgical transformation.

The maximum speed $V_M$ is, for instance, between 2 and 50 meters/second in the case of radial ventilation, or between 10 and 100 meters/second in the case of axial ventilation. The speed of ventilation V is obtained by using preferably a turbine or injection rotary gaseous ring in the case of radial ventilation or a flow of gas parallel to the axis of the wire in the case of axial ventilation, as described further below.

Phase 4

This phase 4 corresponds to the time interval $T_{B2}$, $T_C$. The wire 1 is still traversed by the electric current intensity $I_b$ and the temperature of the wire 1 is still equal to $\theta_b$ but no ventilation is effected, the rate of ventilation being therefore zero. As the time of pearlitization can vary from one steel to another, this phase 4 has the purpose of avoiding applying to the wire 1 a premature cooling corresponding to the phase 5 described further below, in the event that the pearlitization should not be terminated at the time $T_{B2}$.

The duration of this phase 4 is represented by the time interval $P_4$ in the graph of FIG. 2C. In FIG. 2A, the line segment BC passes through the region w arranged between the curves $X_1$, $X_2$, the time $T_{B1}$ corresponding to the intersection of the segment BC with the curve $X_1$, and the time $T_{B2}$ corresponding to the intersection of the segment BC with the curve $X_2$In the direction of increasing times T, the point B is located in front of the region $\omega$ and therefore in a region in which there is no pearlite, the austenite being in metastable state, and the point C is located behind the region $\omega$, that is to say in a zone in which all the austenite is transformed into stable pearlite. The modulated ventilation in FIG. 2C corresponds to the time interval during which the sgment BC passed through the region $\omega$, but this ventilation modulation could be effected for a period of time which does not correspond exactly to the passage through this region $\omega$, for instance for a shorter period of time located completely within the region $\omega$, in order to take into account exothermicity inertias, or for a period of time greater than this passage in order to take into account possible variations in the grades of steel.

Phase 5

This phase 5 corresponds to step (c). No electric current passes through the wire 1 and the wire 1 is ventilated preferably at a high speed $V_c$, greater than the speed $V_a$ of phase 1 so as to have rapid cooling. Rapid cooling is not absolutely necessary upon this last phase 5, but it makes it possible to decrease the overall time of the heat treatment and therefore the length of the installation.

By way of example, $V_c$ has a value between $V_a$ and $V_M$ in graph 2C, but different cases can be contemplated.

The duration of this phase 5 is represented by the time interval $P_5$ in the graph of FIG. 2C and corresponds to the time interval $T_C$, $T_D$. The temperature of the wire 1 at the end of this phase 5 can, for instance, be close or equal to ambient temperature.

Since the values of $\theta$, T, I, V as well as the values of $AC_3$, $AC_1$ and the shape of the curves $X_1$, $X_2$ may vary as a function of the steels, the actual values have not been entered on the axes of graphs 2A, 2B, 2C.

For simplicity in description and embodiment, the temperature of the wire 1 has been assumed constant and equal to $\theta_b$ during phases 2, 3, 4, that is to say during step (b), but the invention applies in the event that during this step (b) the temperature of the wire 1 varies within a range of 10° C. above or below the temperature $\theta_b$ obtained at the end of phase 1. However, it is preferable for the temperature of the wire 1 to be as close as possible to this temperature $\theta_b$. The temperature of the wire 1 is preferably not more than 5° C. above or below said temperature $\theta_b$ upon step (b).

In the embodiment previously described, no electric current passes through the wire 1 during steps (a) and (c), that is to say during phases 1 and 5, but the invention covers cases in which an electric current is passed through the wire 1 during at least a part of one of these phases or these two phases, which may have the advantage of regulating the conditions of the process in flexible manner in one and the same apparatus so as to adapt it to several grades of steel. The means which make it possible to obtain the coolings $R_a$, $R_c$ are then determined by taking this passage of electric current into account.

A device in accordance with the invention for the carrying out of the process of the invention which has been previously described is shown in FIGS. 3 to 7.

This device 2, which is capable of treating eight wires 1 simultaneously, is of a cylindrical shape with a rectilinear axis xx', FIG. 3 being a section through the device 2 taken along said axis, two wires 1 being shown in this FIG. 3.

The device 2 comprises five enclosures designated $E_1$, $E_2$, $E_3$, $E_4$, $E_5$, the wires 1 advancing from the enclosure $E_1$ towards the enclosure $E_5$ in the direction indicated by the arrow F, the letters $P_1$, $P_2$, $P_3$, $P_4$, $P_5$ corresponding to the duration of phases 1 to 5 in these enclosures $E_1$ to $E_5$ (FIG. 3).

The enclosure $E_1$ is shown in detail in FIGS. 4 and 5, FIG. 4 being a section along the axis xx', and FIG. 5 being a cross section perpendicular to this axis, this cross section of FIG. 5 being indicated schematically by the lines V—V in FIG. 4 and the axis xx' being indicated schematically by the letter O in FIG. 5.

The enclosure $E_1$ is limited on the outside by a cylindrical sleeve 3 having an outer wall 4 and an inner wall 5. The sleeve 3 is cooled by a fluid 6, for instance water, which flows between the walls 4 and 5. The inner wall 5 has a plurality of fins 7 in the shape of rings, with axis xx'.

The enclosure $E_1$ comprises a motor-blower group 8. This motor-blower group 8 consists of a motor 9, for instance an electric motor, which permits the driving of two turbines 10 in rotation around the axis xx', each of these turbines 10 being provided with fins 11, the wires 1 being arranged between the fins 11 and the inner wall 5.

The motor-blower group 8 makes it possible to stir the cooling gas 12 in the form of a rotary gaseous ring in the direction of the arrows $F_1$ (FIG. 5), this ring 120 corresponding to the space which separates the fins 11 and the inner wall 5. One thus has a radial ventilation of the wires 1.

The fins 7 permit a good heat exchange between the gas 12 and the water 6.

The enclosure $E_1$ is isolated aerodynamically from the outside and from the following enclosure $E_2$ by two hollow circular plates 13 filled with a cooling fluid 14, for instance water. These circular plates 13 are provided with eight openings 15 which permit the passage of the wires 1.

The enclosure $E_1$ corresponds to phase 1. The wires 1, when they penetrate into the enclosure $E_1$, have a temperature above the $AC_3$ transformation temperature so that they then have a homogeneous austenite structure, and they are cooled rapidly in the enclosure $E_1$ until they reach the temperature $\theta_b$, which is less than the transformation temperature $AC_1$ and greater than the temperature $\theta_p$ of the pearlite nose. The temperature $\theta_b$ permits the transformation of metastable austenite into pearlite, but this transformation does not yet take place in the enclosure $E_1$ since the incubation time $T_{B1}$ at the temperature of the wire $\theta_b$ has not yet been reached and the wires 1 retain an austenite structure.

The wires 1 then pass into the enclosure $E_2$. This enclosure $E_2$ is shown in detail in FIG. 6, which is a section along the axis xx', and in FIG. 7, which is a section perpendicular to the axis xx' of this enclosure $E_2$, the axis xx' being indicated schematically by the letter O in this FIG. 7, the cross section of FIG. 7 being indicated schematically by the lines VII—VII in FIG. 6. This enclosure $E_2$ is without a motor-blower group. Each wire 1 passes between two rollers 16 of electrically conductive material, for instance copper, at the entrance to the enclosure $E_2$, these rollers 16 permitting the passage in each wire 1 of electric current of intensity $I_b$ from this enclosure $E_2$ to the enclosure $E_4$ which will be described in greater detail below. The electric currents flowing in the wires 1 are supplied by transformers 17, each of which provides the electric voltage U and each of these transformers 17 being controlled by a thyristor device 18.

It is thus possible to obtain, at any moment, equality between the heat received by the wires 1 as a result of the Joule effect and the heat emitted by the wires 1, this emission being due to radiation and convection. The temperature of the wires 1 is thus brought to the same value as that reached at the outlet from enclosure $E_1$, that is to say $\theta_b$. For simplicity in the drawing, a single transformer 17 and a single thyristor device 18 are shown in FIG. 3. The enclosure $E_2$ is limited by a hollow cylindrical sleeve 19 in which a cooling fluid 20, for instance water, flows. This cylindrical sleeve 19 is without fins since the heat exchanges between the wires 1 and the cooling gas 12 are slight in the enclosure $E_2$ since they take place with natural convection, that is to say without using mechanical means for placing the gas 12 in movement.

The enclosure $E_2$ corresponds to phase 2, that is to say there is an accelerated formation of seeds at the grain boundaries of the metastable austenite in this enclosure $E_2$, but without there being, as yet, any transformation of austenite into pearlite.

The wires 1 then pass into the enclosure $E_3$. This enclosure $E_3$ is similar to the enclosure $E_1$, but with the following differences:

there are several motor-blower groups 8, arranged one behind the other along the axis xx';

the wires 1 are each traversed by an electric current of intensity $I_b$.

The ventilation due to the groups 8 is modulated, that is to say the speed of rotation of the turbines 10 is low at the entrance to the enclosure $E_3$, it increases and then passes through a maximum along the axis xx' so that the speed of ventilation passes through a maximum $V_M$ and then decreases towards the outlet of the enclosure $E_3$ in accordance with the arrow F. This maximum $V_M$ is, for instance, different from the value of the speed of ventilation in the enclosure $E_1$. The speed of the motor-blower groups 8 can be regulated, for instance, by means of speed regulators 21 which act on the electric motors 9 (FIG. 3), which permits a modulation of the ventilation as a function of the thermal power to be extracted. The enclosure $E_3$ corresponds to phase 3, that is to say in this enclosure $E_3$ there is a transformation of metastable austenite into pearlite, which is effected at the temperature $\theta_b$ of the wires 1. This transformation gives off an amount of heat of about 100,000

J/kg and it does this at a variable rate between the entrance and departure of the wires 1 from this enclosure $E_3$. The production of heat within the wires 1 in this case is the sum of the heat due to the Joule effect, resulting from the electric currents flowing in these wires 1, and of the heat liberated by the austenite-pearlite transformation, which may amount to 2 to 4 times the Joule effect. It is therefore necessary to accelerate the heat exchanges, which is achieved by the modulated radial ventilation previously described, obtained with the motorblower groups 8.

The wires 1 then pass into the enclosure $E_4$, which is identical to the enclosure $E_2$ which has been previously described, except that the rollers 16 are arranged towards the outlet of the enclosure $E_4$, the electric currents therefore flowing in the wires 1 for practically the entire time $P_4$ during which they are in this enclosure $E_4$. The wires 1 are still maintained here at the temperature $\theta_b$.

The enclosure $E_4$ corresponds to phase 4; its purpose is to maintain the wires 1 at the temperature $\theta_b$ so as to be certain that the pearlitization is complete before starting the cooling corresponding to phase 5.

The wires 1 then pass into the enclosure $E_5$, which is similar to the enclosure $E_1$. This enclosure $E_5$ corresponds to phase 5; it permits the cooling of the wires 1 to a temperature which is, for instance, close to ambient temperature. It is not necessary that this cooling be rapid, but it is, however, preferable that the cooling be effected rapidly in order to decrease the length of the device 2.

In order to simplify the assembly and disassembly of the device 2, each sleeve 3 is formed of a plurality of unit sleeves $3_a$ which can be assembled by means of flanges 22.

Circular plates 13, similar to the plates 13 defining the chamber $E_1$, are arranged between the chambers $E_2$, $E_3$, between the chambers $E_3$, $E_4$, between the chambers $E_4$, $E_5$ and at the outlet of the chamber $E_5$. Speed regulators 21 make it possible to vary, if desired, the speeds of the motors 9 in the chambers $E_1$, $E_5$ (FIG. 3).

The fastening of each motor 9 in the enclosures $E_1$, $E_3$, $E_5$ can be effected with a plate 23 which is symmetrical around the axis xx', this plate 23 having an end on which there is fastened the motor 9 and an outer ring fastened to the cylindrical sleeve 3 by flanges 22 (FIG. 4). This outer ring 25 is provided with holes 26 for the passage of the wires 1.

The expression "gas" for the cooling gas 12 is to be understood in a very broad sense; it namely covers an individual gas or a mixture of gases, for instance a mixture of hydrogen and nitrogen.

EXAMPLES

The three examples which follow will make it possible better to understand the invention, the treatment being carried out in the device 2 which has been previously described.

The composition of the steels used is given in the following Table 1 (% by weight).

TABLE 1

| Example | Constituents | | | | | | | | |
|---|---|---|---|---|---|---|---|---|---|
| | C | Mn | Si | S | P | Al | Cu | Cr | Ni |
| 1 | 0.85 | 0.7 | 0.2 | 0.027 | 0.019 | 0.082 | 0.045 | 0.060 | 0.015 |
| 2 | 0.7 | 0.6 | 0.22 | 0.029 | 0.018 | 0.084 | 0.049 | 0.062 | 0.014 |
| 3 | Same composition as Example 1 | | | | | | | | |

The different characteristics of the wires used and the data concerning the austenization are given in the following Table 2.

TABLE 2

| Example | Characteristics of the Wires | | | |
|---|---|---|---|---|
| | $AC_1$ transition temperature (°C.) | Austenization temperature (°C.) | Average rate of heating for austenization (°C./second) | Diameter of the wire (mm) |
| 1 | 721 ± 3 | 920 | 390 | 1.3 |
| 2 | 723 ± 3 | 920 | 395 | 1.3 |
| 3 | As in Example 1 | | | 0.82 |

In all the cases of treatment in accordance with the process of the invention, for each example the following characteristics were complied with:

Number of wires: 8: speed of passage of each wire: 1 meter/second; the characteristics of the cooling gas 12 for the entire device 2 are given in Table 3 below, this gas being a mixture of hydrogen and nitrogen of a composition which varies as a function of the diameter of the wires 1.

TABLE 3

| Diameter of the wires 1 (mm) | % hydrogen by volume | % nitrogen by volume |
|---|---|---|
| 1.3 | 40 | 60 |
| 0.82 | 20 | 80 |

The number of motor-blower groups 8 was one for enclosures $E_1$, $E_5$ and five for enclosure $E_3$, the numbering of these groups 8 being then from 8-1 to 8-5 in the direction indicated by the arrow F for the enclosure $E_3$ as shown in FIG. 3 (for simplicity in drawing, group 8-3 is not shown in this FIG. 3).

The characteristics of treatment of the wires 1 upon phases 1 to 5 are indicated in the following Table 4:

TABLE 4

| Characteristics of Treatment | Example No. | | |
|---|---|---|---|
| | 1 | 2 | 3 |
| Phase 1 | | | |
| Initial temperature of the wires (°C.) | 900 | Identical to phase 1 of Example 1 | Identical to phase 1 of Example 1 |
| Final temperature of the wires (°C.) | 550 | | |
| Diameter of the turbines (mm) | 150 | | |

TABLE 4-continued

| Characteristics of Treatment | Example No. 1 | 2 | 3 |
|---|---|---|---|
| Speed of rotation of the turbines (rpm) | 695 | | 390 |
| Effective velocity of the gaseous ring (meters/second) (rate of ventilation) | 4.2 | | 2.3 |
| Average rate of cooling (°C./second) | 120 | | Identical to phase 1 of Example 1 |
| Time to go from 721° C. to 550° C. (seconds) | 1.6 | | |
| Duration of phase ($P_1$) (seconds) | 2.9 | | |
| Phase 2 | | | |
| Temperature of the wire (°C.) | 550 ± 5 | 550 ± 5 | 550 ± 5 |
| Intensity of each electric current (A) | 22.8 | 22.8 | 10.8 |
| Duration of phase ($P_2$) (seconds) | 0.7 | 0.8 | 0.7 |
| Phase 3 | | | |
| Temperature of the wire (°C.) | 550 ± 5 | 550 ± 5 | 550 ± 5 |
| Intensity of each electric current (A) | 22.8 | 22.8 | 10.8 |
| Effective velocity of the gaseous ring: (ventilation rate): | | | |
| group 8-1 (meters/second) | 1.2 | 1.1 | 0.7 |
| group 8-2 (meters/second) | 4.8 | 3.9 | 2 |
| group 8-3 (meters/second) | 6.2 | 6.6 | 3.3 |
| group 8-4 (meters/second) | 3 | 4.2 | 2.1 |
| group 8-5 (meters/second) | 0.9 | 1.2 | 0.5 |
| Duration of phase ($P_3$) (seconds) | 2.7 | 2.6 | 2.7 |
| Phase 4 | | | |
| Temperature of the wire (°C.) | 550 ± 5 | Identical to phase 4 of Example 1 | 550 ± 5 |
| Intensity of each electric current (A) | 22.8 | | 10.8 |
| Duration of phase ($P_4$) (seconds) | 1 | | 1 |
| Phase 5 | | | |
| Initial temperature of the wires (°C.) | 550 ± 5 | Identical to phase 5 of Example 1 | Identical to phase 5 of Example 1 |
| Final temperature of the wires (°C.) | 100 | | |
| Diameter of the turbines (mm) | 150 | | |
| Speed of rotation of the turbines (rpm) | 765 | | 430 |
| Effective velocity of the gaseous ring (meters/second) (ventilation rate) | 4.6 | | 2.6 |
| Average rate of cooling (°C./second) | 90 | | Identical to phase 5 of Example 1 |
| Duration of phase ($P_5$) (seconds) | 5 | | |

The mechanical properties of the wires obtained are given in Table 5:

TABLE 5

| Example | Elastic limit at 0.2% elongation (MPa) | Ultimate strength (MPa) |
|---|---|---|
| 1 | 1020 | 1350 |
| 2 | 1010 | 1270 |
| 3 | 1040 | 1360 |

The invention is characterized therefore by a process which avoids the use of molten metals, for instance lead, or molten salts during the transformation of austenite into pearlite, due to the combination of the heating of the wire by Joule effect and the modulated ventilation, so that the invention leads to the following advantages:

simple installations of flexible operation;

it is not necessary to clean the treated wire, which can therefore be, for instance, brass-plated and then wiredrawn as is;

there is no health problem since no toxicity need be feared.

Preferably the following relationships apply:

the diameter of the wires 1 is at least equal to 0.3 mm and at most equal to 3 mm; the diameter of the wires is advantageously at least equal to 0.5 mm and at most equal to 2 mm;

during phase 1 the cooling of the wires 1 takes place at an average speed of 100° to 400° C./second;

in phases 2 to 4 the temperature $\theta_b$ of the wire 1 is between 450° and 600° C.;

the effective speed of the rotary gaseous ring at its maximum, in phase 3, varies from 2 to 50 meters/-second;

the effective speed of the rotary gas ring for phase 1 varies from 2 to 50 meters/second.

The rotary gas rings can be obtained by methods other than turbines. Thus FIG. 8 shows, by way of example, an apparatus 30 which makes it possible to obtain a rotary gas ring without using a turbine, this apparatus 30 being capable of use, for instance, in substitution for at least one of the enclosures $E_1$, $E_3$, $E_5$ previously described, FIG. 8 being a cross section taken perpendicular to the axis xx' of the device 2, this axis being represented by the letter O in FIG. 8. The apparatus 30 is limited on the outside by a cylindrical sleeve 31 having an outer wall 32 and an inner wall 33. A cooling fluid 34, for instance water, flows between these walls 32, 33. The apparatus 30 is limited on the inside by a cylinder 35. A series of injectors 36 permits the arrival of the cooling gas 12 into the annular space 37 defined by the cylinders 33, 35, the wires 1 being arranged in this space 37 parallel to the axis xx'. The speed of the gas 12 upon emergence from the injectors 36 is represented by the arrow $F_{36}$. This speed has an orientation substantially perpendicular to the axis xx' and therefore to the wires 1 and it is practically tangent to the imaginary cylinder of axis xx' in which there are contained the wires 1 which are equidistant from this axis xx', that is to say the injection is tangential. One thus obtains a gas ring 38 of axis xx' the speed of which is practically perpendicular to the axis xx'. The speed of the jet of gas upon emergence from the injectors 36 has a value of between two and ten times the value of the speed of the gas ring 38. The emergence of the gas 12 towards the outside of the apparatus 30 is effected due to the pipes 39, the speed of departure of the gas 12 being represented by the arrow $F_{39}$. The openings 360 of the injectors 36 are arranged on a line parallel to the axis xx', two successive openings 360 being separated, for instance, by a distance of 20 to 30 cm. The same is true in the case of the openings 390 of the outgoing pipes 39. For simplicity of the drawing, only a single injector 36 and a single return pipe 39 have been shown in FIG. 8.

A compressor 40 feeds the injectors 36 with gas 12 and receives the gas 12 which comes from the apparatus 30 via the pipes 39.

The distribution of the gas 12 to the injectors 36 is effected by means of the collector 41, and the modulation of the rate of ventilation in the apparatus 30 can be obtained by means of valves 42 arranged at the entrance of each injector 36, these valves 42 making it possible to regulate the rate of flow of gas 12 in these injectors 36.

The collector 43 receives the gas 12 coming from the pipes 39 before this gas enters into the compressor 40.

When the compressor 40 is of the volumetric type, a pressure regulator 44 is provided which maintains a constant pressure difference between the injection collector 41 and the return collector 43.

Fins 45, in the form of rings with axis xx', are fastened to the inner wall 33 so as to promote the heat exchanges.

In order to have good adaptation of the compressor 40 to the requirements of the apparatus 30 it may be advantageous to drive the compressor 40 by a variable-speed motor or else to use a gear box between the motor and the compressor 40.

In the device 2 and the apparatus 30 which have been previously described, the flow of the cooling gas took place radially in the form of gas rings turning around an axis parallel to the metal wires.

The invention also applies to cases in which the circulation of the cooling gas takes place, at least in part, axially, as represented in FIG. 9. The device 50 of this FIG. 9 comprises a blower 51 which makes it possible to introduce the cooling gas 12 into a distribution apparatus 52. This apparatus 52 is shown in further detail in FIGS. 10 and 11. The apparatus 52 comprises a cylinder 53 of axis yy', arranged in an annular chamber 54. The axis yy' is parallel to the wire 1 which passes through the annular chamber 54. FIG. 10 is a cross section through the apparatus 52 along a plane passing through the axis yy' and the wire 1; FIG. 11 is a cross section perpendicular to the axis yy', the cross section of FIG. 11 being indicated schematically by the lines XI—XI in FIG. 10.

The gas 12 emerging from the pipe 55 is introduced tangentially into the chamber 54, the arrow $F_{55}$ which represents the direction of the gas coming from the pipe 55 being substantially tangent to the cylinder 53 and having a direction perpendicular to the axis yy', represented by the letter Y in FIG. 11. The gas 12 introduced into the chamber 54 then forms a gaseous ring 520 which turns around the axis yy', this rotating being indicated by the arrow F52 in FiGS. 10 and 11. The wire 1, outside of the chamber 54, passes into two tubes 56 arranged in front of and behind the chamber 54 in the direction of the arrow F and communicating with said chamber 54. The circulation of the gas 12 around the wire 1 in the chamber 54 is therefore in part radial. The gas 12 then flows along the tubes 56, moving away from the chamber 54, the flow being then parallel to the wire 1, as indicated by the opposite arrows F56, that is to say the flow of the gas 12 is then axial.

Removal lines 57 extending from the tubes 56 permit the flow of the gas 12 out of the tubes 56, these lines 57 debouching in the collector pipe 58 which is connected to the outlet pipe 59. The gas 12 emerging through the pipe 59 is reinjected into the blower 51 in order to be recycled, this path not being shown in the drawing for purposes of simplification. The modulation of the ventilation along the tubes 56, and therefore along the wire 1, is obtained by regulating by valves 60 the rate of flow of gas 12 in each of the withdrawal lines 57. It is thus possible to obtain in the lengths of tubes 56 which are designated 56-1 to 56-4 rates of flow of gas 12 which decrease as one moves away from the apparatus 52 in the direction of the arrows 56, that is to say the ventilation, and therefore the cooling, decrease in this direction. The cooling effect is maximum in the apparatus 52, which makes it possible to subject the wire 1 to a ventilation which is partly radial, the ventilation in the tubes 56 being axial, that is to say the gas 12 flows parallel to the wire 1 in the direction indicated by the arrows $F_{56}$. The heat contributed by the hot wire 1 to the cooling gas 12 is discharged by means of a water/gas heat exchanger 61. For simplicity in the description, only four sections 56-1 to 56-4 have been shown on either side of the apparatus 52, these sections extending away from the apparatus 52 in the direction of the progression 56-1 to 56-4, but one could use a number of sections other than four on each tube 56.

The device 50 can be used for phase 3 of the process in accordance with the invention by replacing the motor-blower groups 8, which permits a simpler technical embodiment.

Ventilation similar to that of the device 50 could also be used in phases 1 and/or 5 of the process of the invention but in this case a modulation of the ventilation is not necessary and it is sufficient to arrange a single withdrawal line 57 at each end of the tubes 56 which is furthest from the apparatus 52.

The technique of axial flow of the gas 12 is easier to utilize than that of radial flow, but it is not sufficient for cooling metal wires of a diameter of more than 2 mm it being necessary in that case to employ a radial-flow technique for the cooling gas.

As previously described, it may be advantageous to pass an electric current through the wire 1 during steps (a) and/or (c); in that case, the device for the carrying out of the process of the invention comprises means for passing an electric current into the wire 1 during these steps, which means may comprise, for instance, the rollers 16 which were described above.

In the embodiments previously described, the passage of the current into the wires 1 was obtained from a source of voltage U by Joule effect, but the passage of the current could also be obtained by induction, the Joule effect devices being, however, preferred since they are easier to produce.

The wire 1 which has been treated in accordance with the invention has the same structure as that of the wire obtained by the known lead patenting process, that is to say a fine pearlite structure. This structure comprises lamellae of cementite separated by lamellae of ferrite. By way of example, FIG. 12 shows, in cross section, a portion 70 of such a fine pearlite structure. This portion 70 comprises two lamellae of cementite 71, practically parallel to each other, separated by a lamella of ferrite 72. The thickness of the cementite lamellae 71 is represented by "i" and the thickness of the ferrite lamellae 72 by "e". The pearlite structure is fine, that is to say the mean value of the sum i+e is at most equal to 1000 Å, with a standard deviation of 250 Å.

The invention is, of course, not limited to the embodiments which have been described above.

What is claimed is:

1. A process for heat treating a carbon steel wire to obtain a fine pearlite structure comprising the steps:

(a) maintaining the wire at a temperature above the $AC_3$ transformation temperature to obtain a homogeneous austenite, and then cooling the wire until it reaches a given temperature which is below the $AC_1$ transformation temperature and above the temperature of the nose of the curve of the start of the transformation of metastable austenite structure without pearlite;

(b) then regulating the temperature of the wire to not more than 10° C. above or below said given temperature, this regulation being obtained by passing an electric current through the wire for a period of time greater than the pearlitization time and by effecting a modulated ventilation for a part of this time; and (c) then cooling the wire.

2. A process according to claim 1, characterized by the fact that it comprises the following five successive phases:

during phase 1 the wire, which has been previously maintained at a temperature above the $AC_3$ transformation temperature, is cooled until the wire reaches said given temperature, the temperature of the wire then being regulated to not more than 10° C. above or below said given temperature, this regulation being obtained by passing an electric current through the wire during the following three phases 2, 3 and 4;

during phase 2, no ventilation is effected;

during phase 3, modulated ventilation is effected;

during phase 4, no ventilation is effected;

the wire is then cooled is phase 5.

3. A process according to claim 1 or 2, characterized by the fact that the cooling of the wire, after pearlitization, is effected to a temperature close to ambient temperature.

4. A process according to claim 1 or 2, characterized by the fact that the modulated ventilation is at least in part a radial ventilation.

5. A process according to claim 4, characterized by the fact that the radial ventilation comprises the formation of a rotary gaseous ring the maximum speed of which is at least equal to 2 meters/second and at most equal to 50 meters/second.

6. A process according to claim 1 or 2, characterized by the fact that the modulated ventilation is at least in part an axial ventilation.

7. A process according to claim 6, characterized by the fact that the maximum speed of the axial ventilation is at least equal to 10 meters/second and at most equal to 100 meters/second.

8. A process according to claim 1 or 2, characterized by the fact that the cooling of the wire before pearlitization and/or the cooling of the wire after pearlitization are effected at least in part by a radial and/or axial ventilation.

9. A process according to claim 8, characterized by the fact that during the cooling of the wire before pearlitization the ventilation is at least in part radial with the formation of a rotary gaseous ring the speed of which is at least equal to 2 meters/second and at most equal to 50 meters/second, or axial with a speed of between 10 and 100 meters/second.

10. A process according to claim 1 or 2, characterized by the fact that the diameter of the wire is at least equal to 0.3 mm and at most equal to 3 mm.

11. A process according to claim 10, characterized by the fact that the diameter of the wire is at least equal to 0.5 mm and at most equal to 2 mm.

12. A process according to claim 1 or 2, characterized by the fact that the cooling of the wire before pearlitization is effected at an average speed of 100 ° to 400° C./second.

13. A process according to claim 1 or 2, characterized by the fact that upon step (b) the temperature of the wire is not more than 5° C. above or below said given temperature.

* * * * *

UNITED STATES PATENT AND TRADEMARK OFFICE

CERTIFICATE OF CORRECTION

PATENT NO. : 4,830,684

DATED : May 16, 1989

INVENTOR(S) : Andre Reiniche

It is certified that error appears in the above-identified patent and that said Letters Patent is hereby corrected as shown below:

Col. 2, line 40, "A-C" should read --2A-C--;

Col. 6, line 19, "$X_2$In" should read --$X_2$. In--;

Col. 6, line 28, "sgment" should read --segment--;

Col. 9, line 54, "end" should read --end 24--;

Col. 9, line 55, "ring" should read --ring 25--;

Col. 10, line 39, "8:" should read --8;--;

Col. 14, line 20, "56" should read --F56--; and

Col. 15, line 20, after "austenite" insert --into pearlite, the wire then having a metastable austenite.--.

Signed and Sealed this

Twenty-ninth Day of May, 1990

*Attest:*

HARRY F. MANBECK, JR.

*Attesting Officer*

*Commissioner of Patents and Trademarks*